US008344629B2

(12) United States Patent
Deixler

(10) Patent No.: US 8,344,629 B2
(45) Date of Patent: Jan. 1, 2013

(54) ELECTRONIC DEVICE HAVING A PLURALITY OF LIGHT EMITTING DEVICES

(75) Inventor: Peter Deixler, Eindhoven (NL)

(73) Assignee: NXP B.V., Eindhoven (NL)

( * ) Notice: Subject to any disclaimer, the term of this patent is extended or adjusted under 35 U.S.C. 154(b) by 355 days.

(21) Appl. No.: 12/671,065

(22) PCT Filed: Jul. 29, 2008

(86) PCT No.: PCT/IB2008/053044

§ 371 (c)(1),
(2), (4) Date: Jan. 28, 2010

(87) PCT Pub. No.: WO2009/016588

PCT Pub. Date: Feb. 5, 2009

(65) Prior Publication Data

US 2010/0201274 A1 Aug. 12, 2010

(30) Foreign Application Priority Data

Aug. 2, 2007 (EP) ..... 07113735

(51) Int. Cl.
*H05B 37/00* (2006.01)

(52) U.S. Cl. ..... 315/149; 315/153; 315/154

(58) Field of Classification Search ..... 315/149, 315/152, 154, 153, 155, 156–159, 291, 307, 315/308

See application file for complete search history.

(56) References Cited

U.S. PATENT DOCUMENTS

| | | | | |
|---|---|---|---|---|
| 6,495,964 | B1 | 12/2002 | Muthu et al. | |
| 6,507,159 | B2 | 1/2003 | Muthu | |
| 2007/0040512 | A1 | 2/2007 | Jungwirth et al. | |
| 2007/0064419 | A1 | 3/2007 | Gandhi | |
| 2009/0015172 | A1 * | 1/2009 | Huang et al. | 315/246 |
| 2009/0015174 | A1 * | 1/2009 | Huang et al. | 315/250 |

FOREIGN PATENT DOCUMENTS

| | | | |
|---|---|---|---|
| WO | 02/080625 | A1 | 10/2002 |
| WO | 2006/011108 | A1 | 2/2006 |
| WO | 2006/054230 | A1 | 5/2006 |
| WO | 2007/069149 | A1 | 6/2007 |

* cited by examiner

*Primary Examiner* — David H Vu

(57) ABSTRACT

The present invention relates to a solid state lighting system which comprises at least one luminaire controller (208, 203), a plurality of light engines (201, 203; 301, 303) each being coupled to a plurality of light emitting devices (RG, B, A) and a single sensor (206, 306) coupled to each of the at least one luminaire controller (208; 308) for sensing the light emitted by the plurality of light emitting devices. The luminaire controller is adapted to control at least one of the plurality of light engines based on the sensing signal from the sensor (206, 306) such that a feedback control loop is implemented. A synchronization connection (205) is provided between the plurality of light engines (101, 103; 301, 303) to synchronize the plurality of light engines (101, 103; 301, 303).

17 Claims, 7 Drawing Sheets

ELECTRONIC DEVICE HAVING A PLURALITY OF LIGHT EMITTING DEVICES

FIELD OF THE INVENTION

The present invention relates to electronic device having a plurality of light emitting devices, a solid state lighting system and a method for controlling a plurality of light emitting devices.

BACKGROUND OF THE INVENTION

Many solid state lighting systems SSL, which are targeted at high-end applications, comprise an optical and/or thermal feedback loop for ensuring color consistency of the incorporated light emitting devices over operating conditions. The light emitting diodes (LEDs) may be disposed underneath an optical systems, which is provided for mixing the colors of the light emitting diodes. An optical sensor measures color and/or intensity of the light (or a sampled representative portion) and provides a feedback signal in accordance with the measured signals to a controller of the lighting system. Such a controller may be an ASSP controller. Placed on user defined color settings and brightness control settings, the ASSP controller provides a control signal, which modulates the LED voltage/current and hence the light. The control method can be pulse width modulation (PWM), pulse code modulation or amplitude modulation (PCM), stochastic pulse density modulation (SPDM) or any other LED control methodology known to the person skilled in the art. In one implementation, the feedback loop requires logic circuitry as well as control mechanisms. This logic task is accomplished by a microcontroller or a state machine, which is to be added to the SSL system to calculate the new settings of current and modulation of the LED according to the feedback results. The control loop maintains basically fixed light output and color setting over variations of time, temperature, and drive conditions. Sensors to be used as color sensing means may be thermal sensors, flux sensors, or color sensors. Typical applications to be implemented by those systems can contain a plurality of light engines featuring light emitting semiconductor devices of several thousands of lumen.

The term light engine is used for defining a device which emits radiation in any region or combination of regions of the electromagnetic spectrum for example, the visible region, infrared and/or ultraviolet region, when activated by applying a potential difference across it or passing a current through it, for example. Therefore a light engine can have monochromatic, polychromatic or broadband spectral emission characteristics. The light engine can in certain implementations also be controlled via a control interface.

FIG. 1 shows a simplified block diagram of a lighting system according to the prior art. The lighting system comprises a AC/DC converter 107, a bus microcontroller 108, a first light engine 101 coupled to several strings of light emitting diodes LEDs and a first optical sensor 105. Each of the strings can be comprised of a different LED colors (for instance, red, blue, green or white) or a combination of colors (e.g. red plus amber). The lighting system furthermore comprises a second light engine 103 which is coupled to several strings of light emitting devices LEDs and a second optical sensor 106. Two light engines 101 and 103 are coupled to several strings of light emitting devices, in this case light emitting diodes. The devices can also be other semiconductor based light emitting devices known by persons skilled in the art such as lasers, OLEDs.

In the example of FIG. 1, the light emitting diodes (LEDs) include a string of red LEDs indicated by R, a string of green LEDs indicated by G, and a string of blue LEDs indicated by B. Further, there is a single LED of amber indicated by A. The light engines 101 and 103 can be realized by using integrated circuits which include the necessary driving and control circuitry in order to drive the light emitting diodes, i.e. the assembly of light emitting diodes in response to a signal provided by the respective optical sensors 105 and 106. In particular, one or a multiplicity of dedicated optical sensors 105 are coupled to a specific light engine 101, and another single or multiplicity of optical sensors 106 are coupled to another light engine 103. Each group of a light engine 101, 103, a group of light emitting diodes, and an optical sensor 105, 106 constitutes its own closed loop control circuit.

The AC/DC converter 107 converts an alternate current power supply of for example 230 volt into a DC voltage of for example 24 volt or the like. The light engines 101 and 102 typically both comprise a microcontroller or another analogue or digital control means 102 and 104, respectively. The controllers 102, 104 are integrated in the light engines in order to establish the necessary control mechanism of the LEDs. External control and adjustment of the lighting system can be supplied via a control bus 110, which is for example can be a PC bus, DMX bus, DALI bus, CAN bus or any other bus protocol known to persons skilled in the art. The luminaire bus microcontroller 108 receives external instructions such as brightness, color-point or light effects via another bus using typical communication protocols as DMX, DALI, or ZigBee. The typical features of this conventional architecture provide that every light engine comprises its own dedicated controller for controlling the LED coupled to the light engine. Accordingly, controllers are provided at both, the luminaire and the light engine level. Further, every light engine has its own optical feedback loop, with a single flux or color sensor per system.

U.S. Pat. No. 6,507,159 B2 relates to a system for RGB based luminary. A plurality of photo diodes are used as color sensors to detect light from light emitting diodes. The measurements of the photo diodes are forwarded to a controller which is adapted to control the light emitting diodes such that a feedback loop is established.

U.S. Pat. No. 6,495,964 B1 concerns a luminaire system with red, green and blue light emitting diodes and a photodiode arrangement for measuring the light from the RGB light emitting diodes LED. The light of the RGB LED is measured in each color separately in a sequence of time pulses. The measurements of the photodiodes are forwarded to a controller which is controlling the RGB LED to provide a feedback loop.

Therefore, a basic disadvantage of the prior art consists in the considerably high number of controllers and sensors necessary to establish feedback control of the prior art systems.

SUMMARY OF THE INVENTION

It is an object of the present invention to provide an electronic device allowing to implement systems of light emitting semiconductors devices with less complexity and costs.

This object is solved by an electronic device according to claim 1, a solid state lighting system according to claim 5 and a method for controlling a plurality of light emitting devices according to claim 6.

Therefore, an electronic device having a plurality of light emitting devices is provided, which comprises at least one luminaire controller, a plurality of light engines each being coupled to a plurality of the light emitting devices for driving at least one light emitting device and a sensor coupled to each of the at least one luminaire controller for sensing the light emitted by the plurality of light emitting devices, wherein the luminaire controller is adapted to control at least one of the plurality of light engines based on the sensing signal from the sensor such that a feedback control loop is implemented. A synchronization connection is provided among the plurality of light engines to synchronize the plurality of light engines.

According to an aspect of the invention each light engine comprises a synchronization input and a synchronization output.

According to a further aspect of the invention the sensor comprises at least one of a color sensor, a flux sensor and a thermal sensor.

The invention also relates to a solid state lighting system which comprises at least one luminaire controller, a plurality of light engines each being coupled to a plurality of the light emitting devices for driving at least one light emitting device and a sensor coupled to each of the at least one luminaire controller for sensing the light emitted by the plurality of light emitting devices, wherein the luminaire controller is adapted to control at least one of the plurality of light engines based on the sensing signal from the sensor such that a feedback control loop is implemented. A synchronization connection is provided among the plurality of light engines to synchronize the plurality of light engines.

The invention further relates to a method for controlling a plurality of light emitting devices. At least one light emitting device is driven by a light engine coupled to the light emitting device. The light emitted by the plurality of light emitting devices is sensed by a sensor unit wherein the sensor is coupled to a luminaire controller. At least one of the plurality of light engines are controlled based on the sensing signal from the sensor unit by means of a luminaire controller such that a feedback control loop is implemented. A synchronization connection is provided between the plurality of light engines to synchronize the plurality of light engines.

The invention relates to the idea to share a single optical sensor between a plurality of light engines, instead of a plurality of feedback or feedforward sensors (for example optical or thermal sensor) even if several light engines are provided in a solid state lighting system. Herein the optical sensor is coupled to a luminaire controller which in turn is coupled to each of the light engines of the lighting system. Therefore, the light engines are adapted to share a common feedback/feedforward loop such that several sensors as well as feedback loops can be left out thus reducing the overall cost of the system.

In a preferred embodiment, the synchronization connection between the light engines is arranged as a bus over which a synchronization signal can be sent. The synchronization may then be achieved in that one light engine is adapted to operate as a parent, and the other as a child. This adaptation may be effected by design of the light engine. However, it is not excluded, and even preferred, that the creation of the parent occurs by means of software or even according to an automatic routine: if a light engine, in an initialization phase, has not received any synchronization signal over a specific bus within a certain period of time, it will send out one. After reception of a predefined return signal, the initialization phase will be finalized, and the light engine will operate to the further light engine, as a parent. As a consequence hereof, a light engine may be a parent in view of one further light engine, but act as a child in view of another light engine.

According to a further modification of this embodiment, an initial state and a full operation state can be distinguished for both the parent and the child mode of operation. The initial state involves programming of a memory, such as initialization of a shift register.

According to another modification the synchronization signal is derived from a clock generator, which includes at least three states: a standby state, a parent mode state and a child mode state. In a further implementation of this child mode state, the clock generator is arranged to be part of a phase locked loop. The frequency is then locked to the frequency of the parent light engine via the synchronization signal.

In an even further embodiment, use is made of an oscillator, divider circuitry for the generation of the clock signal and a phase detector block at the output thereof. This phase detector block has the functionality that either the internally generated clock signal is used, or that a clock signal is used that is received from a different engine.

In one further specific embodiment, the light engine in the parent mode will issue additional signals to enable that all light engines take over the same modulation. This can be achieved, for instance, with pulse width modulation. Then additional pulses are issued by the parent. It appears suitable according to the inventor to issue such pulses in the first quarter of the PWM period after a normal SYNC pulse. However, it is not excluded that a system is arranged to issue such pulses in another quarter, such as the second quarter, the third quarter or the fourth quarter. Evidently, the light engines are designed that the phase locked loops in the child modes are not disturbed by these additional pulses.

In a further embodiment, the update commands are issued by the parent. Though the preceding modulation period may be shortened, the actual update moment probably occurs later. In order to enable a smooth adaptation of the modulation cycle, for instance a pulse width modulation cycle, additional signals may be provided. Such signals are used, for instance, to indicate then the revised modulation cycle.

In an even further embodiment, the driver ICs, e.g. state machines is provided with means for programming the strength of signals sent over the synchronization line. This is expected to result in power savings, as the drive strength may be flexibly tailored to the real needs in the application. This is particularly useful for luminaires in view of the long length of synchronization lines therein. The means suitably include any time of non-volatile memory. It is not excluded that such means are provided also for other signal lines than merely the synchronization line, and even outside the architecture of the present invention.

As a result of the architecture of the present invention with a reduced number of sensors, the use of separate microcontrollers in addition to state machines, as part of the light engine, appears not completely economical. For this reason, in one embodiment, the microcontroller function is integrated in the state machine, e.g. driver integrated circuit, while its controller function is reduced to a controller unit on the basis of a look up table. Such a look up table is suitably provided as a hardcoded ROM memory, though another type of memory is not excluded.

While the above-mentioned approach suggests to be a reduction in functionality, the present inventor has understood that this does not need to be the case. In fact, customers tend to be satisfied with a limited number of states only. Examples hereof are for instance a state 'cool white' and another state 'warm white'. The benefit of the reduction to a limited number of states is not merely that costs may be reduced, but also that the overall reaction speed of the system will be increased. The generation of a driver IC with included microcontroller function on the basis of a look up table with a limited number of states is believed to have a potential that extends even outside the architecture of the present invention.

BRIEF DESCRIPTION OF THE DRAWINGS

These and other aspects of the invention will be apparent from and elucidated with reference to the embodiments described hereinafter. In the following drawings

DETAILED DESCRIPTION OF THE EMBODIMENTS

According to the embodiments of the present invention the term light engine is used for defining a device which emits radiation in any region or combination of regions of the electromagnetic spectrum for example, the visible region, infrared and/or ultraviolet region, when activated by applying a potential difference across it or passing a current through it. Therefore a light engine can have monochromatic, polychromatic or broadband spectral emission characteristics. The light engine can in certain implementations also be controlled via a control interface.

Figure 1:
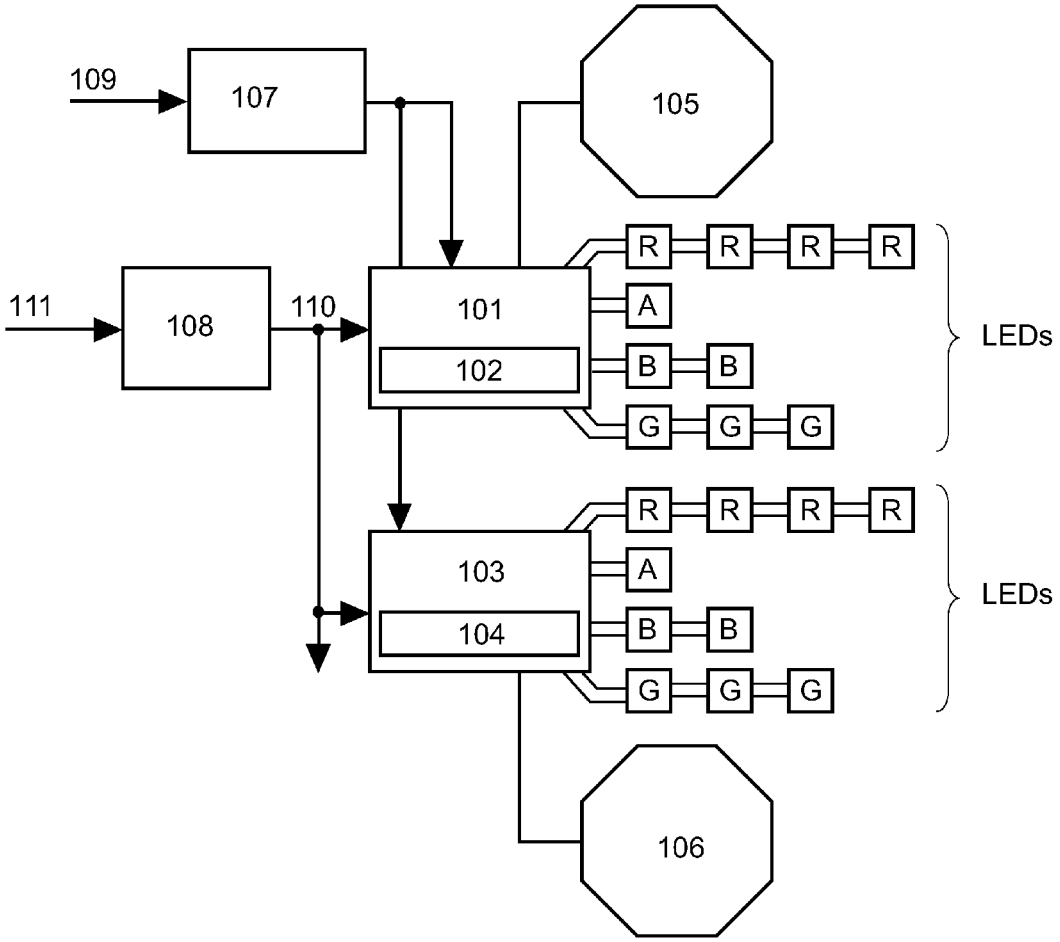
Fig.1 (Prior Art)
FIG. 1 shows a simplified block diagram of a lighting system according to the prior art.
Figure 2:
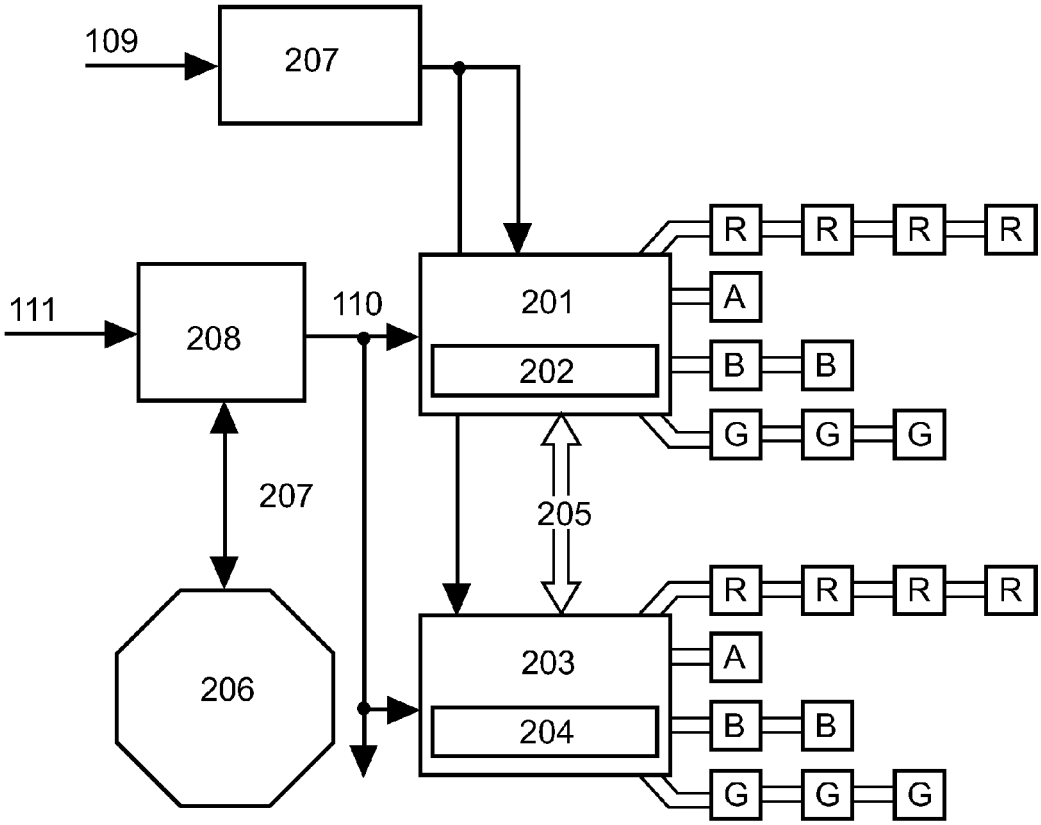
FIG. 2 shows a simplified block diagram of a lighting system according to a first embodiment of the present invention.

FIG. 2 shows a simplified block diagram of a solid state lighting system according to a first embodiment of the present invention. The solid state lighting system comprises a AC/DC converter 207, a first light engine 201 coupled to a plurality of light emitting diodes and a second light engine 203 coupled to a further plurality of light emitting diodes, a single sensor 206 and a luminaire controller 208. The two light engines 201 and 203 are supplied with a DC voltage, e.g. 24 V by the AC/DC converter 207 from the AC power supply of for example 230 volt. However, the LED can also be supplied directly by AC voltage. The light engines 201 and 203 include a controller 202 and 204, respectively, for controlling the light emitting diodes coupled to each of the light engines. The setting and control of the light engines for controlling the LEDs is carried out by the luminaire controller 208 via the bus 110, which may also be an $I^2C$ bus. The luminaire controller 208 in turn receives the setting and adjustment commands via a bus 111 having the typical protocols as for example DMX, DALI or ZigBee.

The configuration according to the first embodiment of the present invention provides only a single sensor 206 per luminaire (micro-)controller 208. The sensor 206 is (directly) coupled to the luminaire controller 208. The sensors 206 can be optical, thermal, pressure, mechanical strain, proximity sensors or any other sensor known to people skilled in the art. In the case of an optical sensor, it can be implemented for instance with a color sensor or flux sensor. The color sensor measures the tri-stimulus values and compares it with the target setting. The flux sensor is only capable of measuring the total flux without giving accurate spectral information. Hence, for flux sensing the various LED colors are typically measured in sequence (for instance multiplexing can be applied, first only switch on the red LEDs and measure the flux; then the green LEDs switched on and measured. The single sensor is used for at least some of the light emitting diodes being driven by two or more light engines 201, 203. Using only a single optical flux sensor 206 per luminaire controller can be advantageously performed if a synchronization mechanism is present among the light engines in order to synchronize their driving signals with respect to each other. In addition to flux sensors, any other sensor which assesses a time-dependent property dependent on multiple light engines can benefit from the above synchronization approach (e.g. temperature or mechanical stress) Therefore, a synchronization connection 205 is provided between the two light engines 201 and 203. The control loop from the light emitted by the light emitting diodes, via the optical sensor 206 now also includes the luminaire microcontroller 208. In response to the sensing signal 207 arriving from the sensor 206, the microcontroller 208 provides corresponding commands over the bus 110 to the light engines 201 and 203 in order to adjust the driving means for the light emitting diodes appropriately. The optical sensor 206 would typically be arranged such that the light emitted by the light emitting diodes from both light engines can be sensed. Accordingly, the multiple light engines are adapted to share a common (optical) feedback loop, which reduces the overall costs of the system. Further, sharing an (optical) control feedback loop requires synchronization between the light engines 201, 203. The synchronization mechanism will be described here below in more detail.

Figure 3:
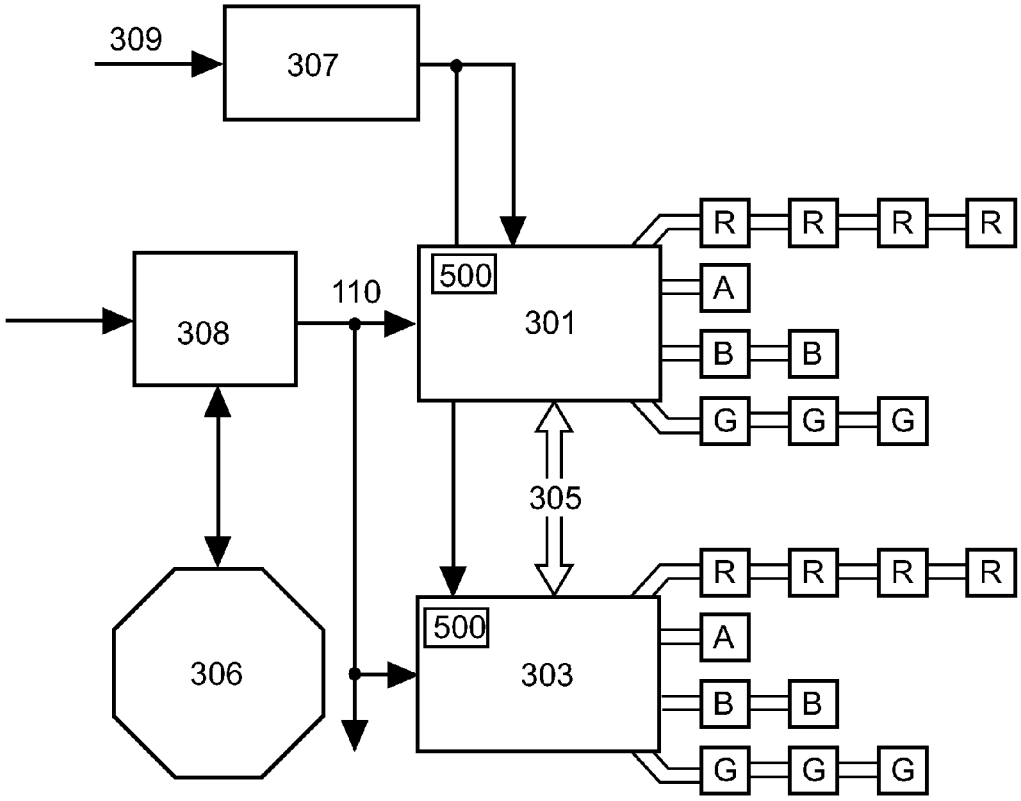
FIG. 3 shows a simplified block diagram of a lighting system according to a second embodiment of the present invention.

FIG. 3 shows a simplified block diagram of a lighting system according to a second embodiment of the present invention. The lighting system according to the second embodiment substantially corresponds to the lighting system according to the first embodiment. The only difference between the lighting system according to the second embodiment as compared to the lighting system according to the first embodiment is that the light engines according to the second embodiment do not comprise dedicated microcontrollers. The light engines 301 and 303 for each of the group of light emitting diodes are coupled by a synchronization mechanism 305. The light engines 301 and 303 provide corresponding input and output means for communicating a synchronization signal from one light engine to another. The light engines according to the second embodiment do not include a microcontroller any more. The microcontroller functionality is arranged only in the luminaire microcontroller 308. A single optical sensor per luminaire 306 is coupled to the microcontroller 308 via connection 307. The single optical sensor 306 is adapted and configured to sense the light emission of the light emitting diode of more than one light engine 301, 303 such that a control feedback loop (LED, sensor luminaire controller, light engine and LEDs) is provided. The power supply is generated and supplied to the light engines as explained before by the AC/DC converter 307. Also, the communication protocols DMX, DALI, or ZigBee can be used to communicate the adjustment and control settings to the luminaire microcontroller 308. According to this configuration, only one centralized microcontroller per luminaire and only one sensor is provided. This single microcontroller is shared by at least two light engines. The overall lighting system equipped with such a configuration is easier and simpler to implement and cheaper in production. According to a specific aspect of this invention, the power management ASIC of the light engine may be adapted to produce the pulse width modulating signals (PWM signals) for the light emitting diodes.

Figure 4:
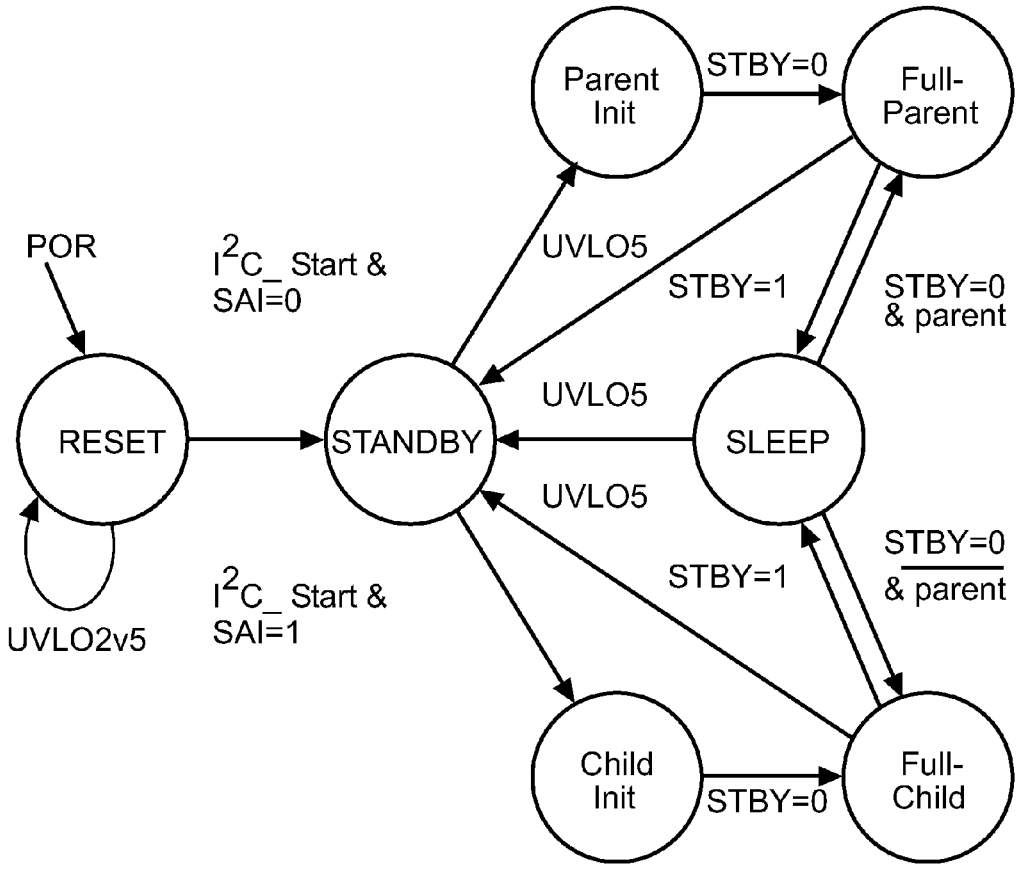
FIG. 4 shows a control state diagram of a state machine according to an embodiment of the invention.

FIG. 4 shows a control state diagram of a state machine according to an embodiment of the invention. The state diagram of the state machine illustrates the mechanism and protocol to implement full control over a plurality of light emitting diodes being coupled to several light engines. The control may be implemented in a single microcontroller of the luminaire controller based on the measurements of a single optical light sensor. Each of the light engines 301 and 303 as shown in FIG. 3 may operate in two major modes, namely Parent- or Child-mode. Further, the light engines provide a standby or a sleep mode, in which a minimum amount of current is drawn from the supply inputs. The default mode after power up is the standby mode, while the default mode after switch-off is the sleep mode. In case the supply voltage drops below a minimum voltage, the standby mode is always entered unconditionally. Dependent on the value of a specific or dedicated input pin of the light engine, the circuit starts operation in one of the major modes at the first occurrence of a start condition on the $I^2C$ bus. If, for example, the dedicated input pin is low, the parent mode will be entered. If the dedicated input pin is high, the Child-mode will be used. Two different modes are necessary for proper operation, when more than one light engine is used in the same application, e.g. in the same luminaire. According to this aspect of the present invention, it is possible to use only a single sensor for detecting the light from the light emitting diodes of a plurality of light engines. Thermal sensors, flux sensors, and color sensors may be used. However, one preferred solution according to the present invention is a flux sensor. The configuration, in which the flux of each individual subsystem is to be measured, the pulse width modulation signals of a subsystem need to be synchronized. In order to achieve synchronization, one light engine is adapted to operate as Parent and generate a synchronization signal SYNC, which is derived from the clock generator of the light engine running at the nominal frequency. The other light engines, operating as children (Child), may use the synchronization signal SYNC to lock the clock oscillator and to synchronize their PWM generators. The Parent-mode as well as the Child-mode are both divided into two states. These states are the initial and the full state. In the initial state, all registers linear feedback shift registers LFSR may be properly initialized, while the output are still inactive. Setting standby STBY to zero established full operation in the Parent- or in the Child-mode. By setting the standby bit via the PC bus, the light engine may be put into sleep mode SLEEP. As indicated by the arrows UVLO5, the light engine enters the standby mode STANDBY, if, for example, a 5 V power supply is not sustained. Other voltage levels may be used, if different supply voltage levels are available. A new initialization cycle is to be performed, before full operation can be resumed.

Figure 5:
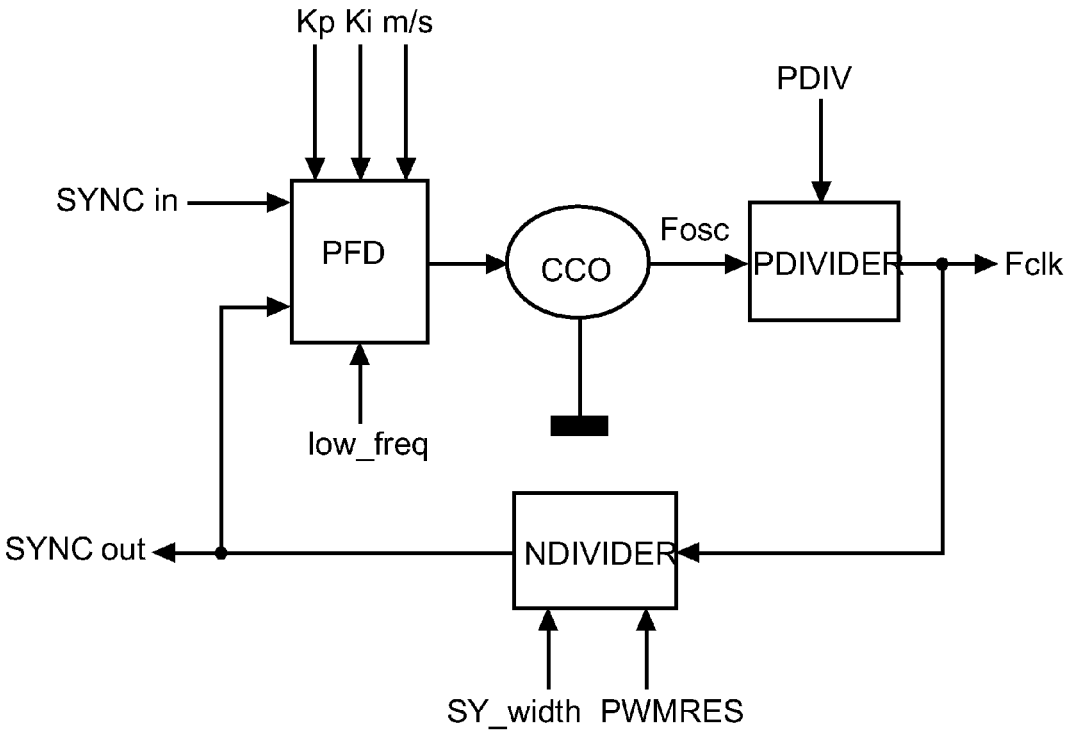
FIG. 5 shows a simplified block diagram of a clock generator according to an embodiment of the present invention.

FIG. 5 shows a simplified block diagram of a clock generator according to a third embodiment of the present invention. The clock generator 500 can be provided in a light engine according to the present invention and provides the system clock for all digital circuitry not running on the timing information over the PC bus. The clock generator according to the present invention provides three operating modes, a) one for standby, having a low frequency, but still free running to enable a quick reaction to PC bus commands, b) a Parent-mode, in which the frequency (for example 35 MHz) may also be in a free running mode, and c) one Child-mode, in which the generator is part of a phase locked loop, where the frequency will be locked to the frequency of the parent light engine via the synchronization input signal SYNC. The actual system clock frequency may be adjusted over a range of $F_{OSC}/P$, where P may be set to a wide range of integer values between 1 and N, where N may for example be 8. The setting may be achieved by storing the value in a register in the light engine. The configuration of the phase locked loop PLL as shown in FIG. 5 includes a current controlled oscillator CCO producing a free running oscillation frequency $F_{OSC}$ and a divider circuitry PDIVIDER. The dividing circuitry PDIVIDER is set by the division value PDIV. The output frequency FCLK of the PDIVIDER is fed back to a dividing block NDIVIDER. The output of NDIVIDER constitutes the synchronization output signal SYNCOUT. The phase frequency detector block PFD receives the synchronization output signal SYNCout and the synchronization input signal SYNCin from a different light engine. So, this configuration allows to use either a synchronization mechanism or signal provided by another light engine, or to produce a synchronization signal SYNCout for other light engines in the Parent-mode.

Figure 6:
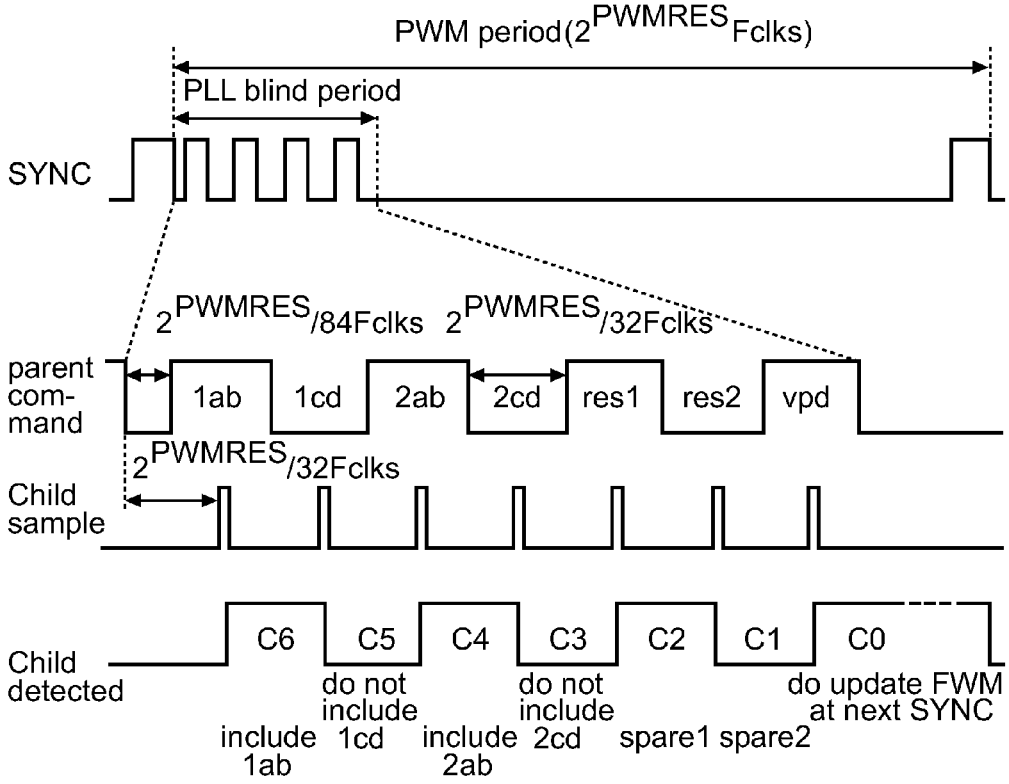
FIG. 6 shows wave forms relating to the synchronization mechanism according to an embodiment of the present invention.

FIG. 6 shows wave forms relating to the synchronization mechanism according to an embodiment of the present invention. The clock generator according to FIG. 5 divides the clock frequency by $2^{PWMRES}$, where PWMRES determines the resolution of the internally generated pulse width modulation signals. The resulting synchronization frequency and the pulse width modulation frequency may be calculated by the following formula:

$$Fsync=(Fosc/Pdiv)/2^{N}.$$

The width of the pulse output by the NDIVIDER block is programmable by the parameter SY_Width via the $I^2C$ bus. The pulse is fed to one of the phase comparator inputs of the phase frequency detector PFD. In Parent-mode, this pulse is put on the output pin SYNCOUT as well. The signal being present on the SYNCIN pin is fed to the other phase comparator input of the phase frequency detector PFD. Accordingly, the phase locked loop used for the synchronization generator is able to lock to the incoming synchronization signal SYNCIN in Child-mode by comparing its internally generated synchronization signal with the one of the parents in order to synchronize the flux measurement sequence, and in order to take over a new pulse width modulation (PWM) setting in all submodules, the light engine in parent mode will issue extra pulses in the first quarter of the PWM period after a normal SYNC pulse. This is indicated by the error PLL blind period, i.e. the PLL clock is blind for a synchronization pulse during this blind period.

Figure 7:
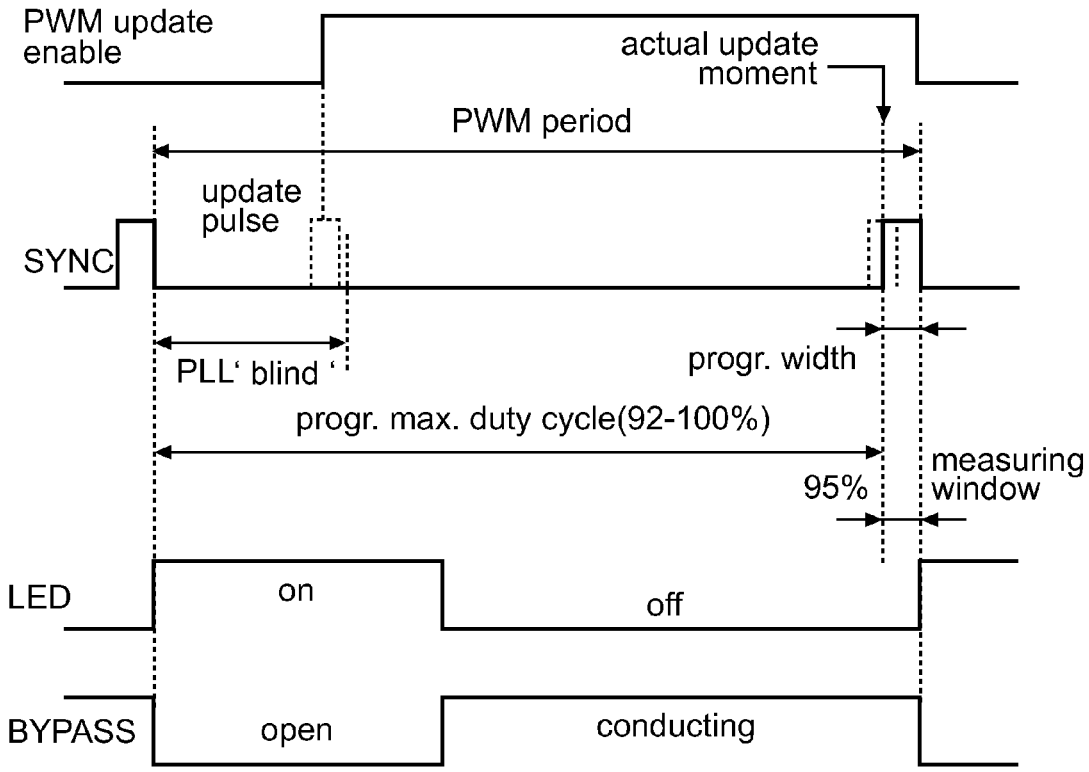
FIG. 7 shows wave forms according to an embodiment of the present invention.

FIG. 7 shows wave forms according to a further aspect of the present invention relating to the synchronization behavior and the specific timing of synchronization. Accordingly, if a pulse width modulation update command is issued, the previous pulse width modulation period may be shorter. The actual update moment occurs now later than previously programmed. Accordingly, a smooth adaption of the pulse width modulation cycle being also indicated by the signals LED (the driving current through the light emitting semiconductor devices on or off) and corresponding bypass switch BYPASS.

The microcontroller in the above configurations according to aspects of the present invention may be replaced by state machines with hard coded read only memory. These state machines may be integrated in the electronics of the light engine in order to perform the matrix calculations of the color calculations. They may also be included in an on-chip memory for offset corrections and wave length or flux of the light emitting semiconductor devices. Further, using state machines may also enable totally microcontroller-free luminaire architectures. Accordingly, a standard microcontroller may be replaced by memory lookup tables and state machines, which allows cheaper production and smaller and less complex devices. Further, the application-specific integrated circuits (ASIC), which may be used for aspects of the present invention, may feature the capability to store calibration data of light engine systems on chip. For example, the on-chip calibration data may include the driver deviation, as well as the deviation of the light emitting diodes during the whole lifetime. A particular advantage results from storing the calibration data in the integrated circuit device according to the present invention, as only the light emitting diodes and the driving means for the light emitting diodes have to be considered for calibration. In conventional systems, the full light engine is to be calibrated, which includes the driver, the microcontroller, and the light emitting semiconductor devices. From a perspective of complexity of the system, the conventional approach is disadvantageous. According to an aspect of the present invention, a simplified supply chain may be implemented, where information regarding the light emitting diodes or light emitting semiconductor devices may be stored on the light engine subsystem consisting only of a driver ASIC and the corresponding light emitting diodes. Calibration of the microcontroller is not necessary any more in this configuration.

Still further, it is also possible to use non-volatile memory to program the driving strength of bus drivers and synchronization lines. This will enable power savings, as the driving strength and the power dissipation may be flexibly tailored to the real needs in the application. In particular, the length of luminary products and the corresponding length of the bus and the synchronization lines may range from a few centimeters to several meters. Further, a power-on-timer may be integrated into the light engine according to the present invention. This may be realized by a non-volatile memory as an EEPROM. Accordingly, the light engine is enabled to store information about the period of time, temperature as well as current, power, or duty cycle, during which each of the light emitting semiconductor devices has been operated. This information enables accurate light emitting semiconductor device degradation feed forward, by using the degradation data provided by the light emitting semiconductor device manufacturer. The on-time counter may be implemented on-chip or off-chip.

While the invention has been illustrated and described in detail in the drawings and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single or other unit may fulfill the functions of several items recited in the claims. The mere fact that certain measures are recited in mutually different dependent claims does not indicate that a combination of these measured cannot be used to advantage.

Any reference signs in the claims should not be construed as limiting the scope.

The invention claimed is:

1. Electronic device having a plurality of light emitting devices, comprising:

at least one luminaire controller, a plurality of light engines each being coupled to a plurality of the light emitting devices for driving at least one light emitting device, and a sensor unit coupled to each of the at least one luminaire controller for sensing the light emitted by the plurality of light emitting devices, wherein the luminaire controller is adapted to control at least one of the plurality of light engines based on a sensing signal from the sensor unit such that a feedback control loop is implemented, and wherein a synchronization connection is provided between the plurality of light engines to synchronize the plurality of light engines.

2. Electronic device according to claim 1, wherein each light engine comprises a synchronization input and a synchronization output.

3. Electronic device according to claim 1, wherein the sensor unit comprises at least one of a color sensor, a flux sensor and a thermal sensor.

4. Electronic device according to claim 2, wherein:

the plurality of light engines have a parent-mode and a child-mode which are activated by a synchronization signal received at the synchronization input, a light engine in the parent-mode outputs a synchronization signal at its synchronization output, and the synchronization signal from the synchronization output of the light engine in parent-mode is used by a light engine in child-mode to synchronize with the light engine in parent-mode.

5. Solid state lighting system, comprising:

at least one luminaire controller, a plurality of light engines each being coupled to a plurality of light emitting devices for driving at least one light emitting device, and a sensor unit coupled to each of the at least one luminaire controller for sensing the light emitted by the plurality of light emitting devices, wherein the luminaire controller is adapted to control at least one of the plurality of light engines based on a sensing signal from the sensor unit such that a feedback control loop is implemented, and wherein a synchronization connection is provided between the plurality of light engines to synchronize the plurality of light engines.

6. Method for controlling a plurality of light emitting devices using a plurality of light engines, comprising the steps of:

driving at least one light emitting device by a light engine coupled to a plurality of the light emitting devices, sensing the light emitted by the plurality of light emitting devices by a sensor unit wherein the sensor is coupled to a luminaire controller, and controlling at least one of the plurality of light engines based on a sensing signal from the sensor unit by means of the luminaire controller such that a feedback control loop is implemented, wherein a synchronization connection is provided between the plurality of light engines to synchronize the plurality of light engines.

7. The device of claim 1, wherein:

a first one of the a light engines is configured and arranged to output a synchronization signal via the synchronization connection, and a second one of the light engines is configured and arranged to use the synchronization signal received from the first one of the light engines via the synchronization connection to synchronize with the first one of the light engines.

8. The device of claim 7, wherein the second one of the light engines includes a phase locked loop having a clock generator configured and arranged to lock to the frequency of the synchronization signal received from the first one of the light engines.

9. The device of claim 8, wherein the second one of the light engines includes a phase detector block configured and arranged to select between a clock signal provided by the clock generator and a clock signal received from a different one of the light engines.

10. The device of claim 7, wherein the second one of the light engines is configured and arranged to use the synchronization signal to synchronize with the first one of the light engines while operating in a child mode, and to operate in a parent mode to output a second synchronization signal to a third one of the light engines, the third one of the light engines being configured and arranged to operate in a child mode to use the second synchronization signal received from the second one of the light engines via the synchronization connection to synchronize with the second one of the light engines.

11. The device of claim 1, wherein the sensor unit is configured and arranged to sense light emitted from different ones of the light emitting devices at different times, and to provide a signal corresponding to the sensed light to respective luminaire controllers that control the light emitting devices from which the light is sensed.

12. The system of claim 5, wherein:

a first one of the a light engines is configured and arranged to output a synchronization signal via the synchronization connection, and a second one of the light engines is configured and arranged to use the synchronization signal received from the first one of the light engines via the synchronization connection to synchronize with the first one of the light engines.

13. The system of claim 5, wherein:

each of the light engines is configured and arranged to operate in a parent-mode and a child-mode responsive to a synchronization signal, a first one of the a light engines is configured and arranged to operate in the parent-mode by outputting a first synchronization signal, and a second one of the light engines is configured and arranged to operate in the child mode in response to the first synchronization signal, and to use the first synchronization signal to synchronize with the first one of the light engines.

14. The system of claim 5, further including the plurality of light emitting devices.

15. The system of claim 5, wherein the sensor unit is configured and arranged to sense light emitted from different ones of the light emitting devices at different times, and to provide a signal corresponding to the sensed light to respective luminaire controllers that control the light emitting devices from which the light is sensed.

16. The method of claim 6, further including, at a first one of the light engines, outputting a synchronization signal via the synchronization connection, and at a second one of the light engines, using the synchronization signal from the first one of the light engines received via the synchronization connection to synchronize with the first one of the light engines.

17. The method of claim 6, further including:

at a first one of the a light engines, operating in a parent-mode by outputting a first synchronization signal, and at a second one of the light engines, operating in a child mode in response to the first synchronization signal, and using the first synchronization signal to synchronize with the first one of the light engines while operating in the child mode.

* * * * *